United States Patent [19]

Goldhammer

[11] 4,430,934

[45] Feb. 14, 1984

[54] SAFETY AND WARNING DEVICES FOR BALING PRESSES

[76] Inventor: Albert Goldhammer, Zum Hecht 46, 7770 Überlingen, Fed. Rep. of Germany

[21] Appl. No.: 198,163

[22] Filed: Oct. 17, 1980

[30] Foreign Application Priority Data

Oct. 18, 1979 [DE] Fed. Rep. of Germany ..... 2942219
Oct. 18, 1979 [DE] Fed. Rep. of Germany ..... 2942228

[51] Int. Cl.[3] ..... B30B 15/14
[52] U.S. Cl. ..... 100/53; 100/250
[58] Field of Search ..... 100/53, 240, 250, 289

[56] References Cited

U.S. PATENT DOCUMENTS 2,813,569 11/1957 Nelson ..... 100/53

*Primary Examiner*—Billy J. Wilhite

*Attorney, Agent, or Firm*—Boniard I. Brown

[57] ABSTRACT

A safety device is provided for a baling press, wherein a press piston or plate is reciprocable in a press housing, for inactivating a pressing plate drive when a filler lid is opened. The safety device has a switch disposed on the housing in a position which is remote from and is separated from the filler lid and the opening path of the lid, and has a lever pivotally mounting the lid with an arm of the lever extending oppositely from the lid, with a control rod connected with the lever means arm part to engage the switch by moving in response to opening movement of the lid to engage and operate the switch to inactivate the plate drive. The lever may be a two-armed angle lever pivotally mounted on the press housing, and the control rod may be connected with an energy store, typically a spring. The control rod may have an angled portion for operating engagement with a sensing roller of the switch.

14 Claims, 5 Drawing Figures

1
2
3
4
5
6
7
7A
8
9
10
11
12
13
14
15
16
17
18
19
20
37
38
39

FIG 2
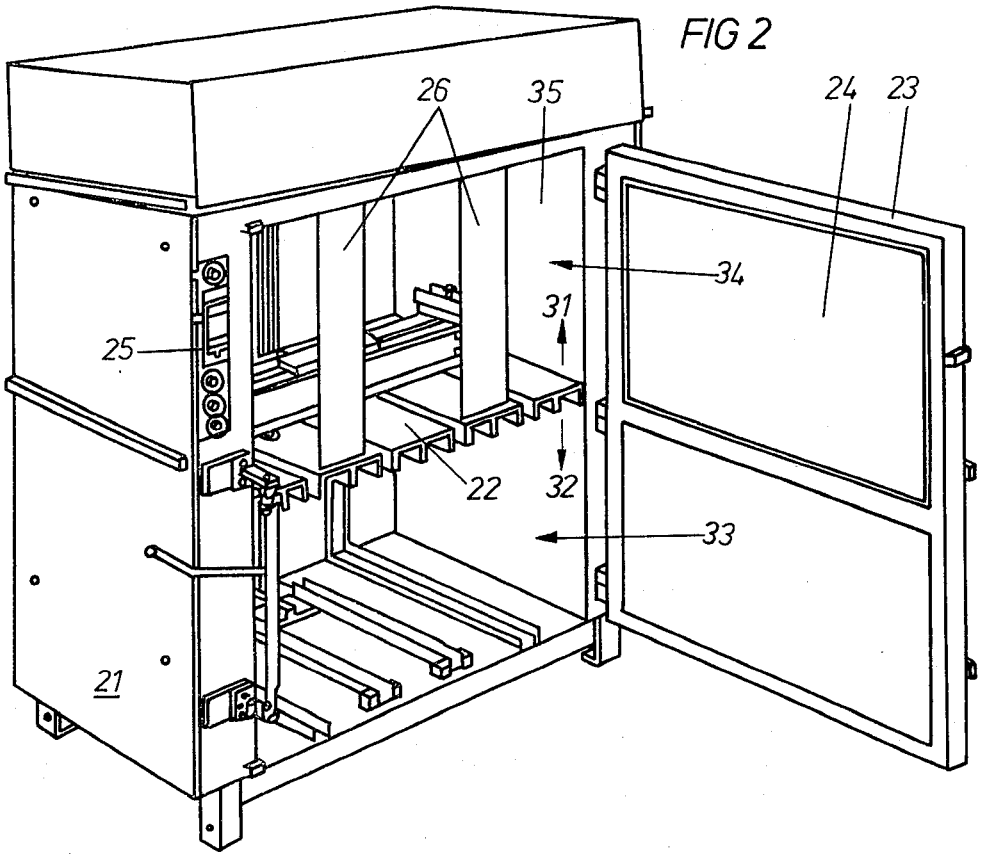
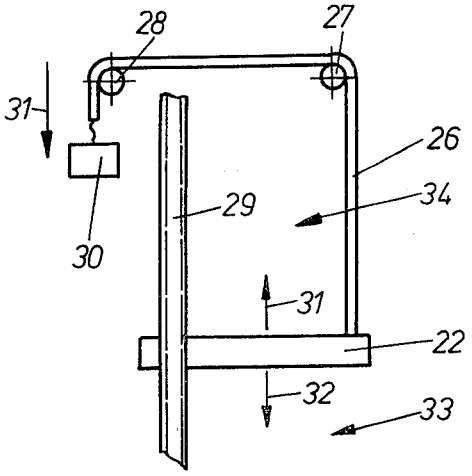
FIG 3
FIG 4
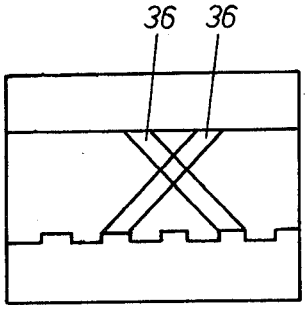

SAFETY AND WARNING DEVICES FOR BALING PRESSES

The invention relates to a safety device in a baling press for switching off the pressing plate drive when the filler lid is opened by means of a switch disposed in the opening path of the filler lid, and to a warning device when the filler lid is opened.

With previously known filler lids it has been found disadvantageous that the filler lid had to be lifted up by physical force in order to be fixed in a more or less stable final position. Moreover the weight of the filler lid upon closing by physical force had to be damped in order to avoid too great a force on the press housing.

It was also disadvantageous that the switch for the pressing plate drive had only short operating paths.

An object of the present invention is to develop a safety device in a baling press such that irrespective of the amount of wear on the switch, an identical opening angle of the filler lid is always achieved.

A further object of the present invention is to obviate the inconvenient raising and lowering of the filler lid by physical force. The invention is characterized in that the filler lid is coupled via an angle lever and a set of operating rods, to an energy store and by displacement of the rods the switch is operated.

An essential feature of the present invention is that the filler lid is hinged to an angle lever which is coupled to an energy store at its other end. Thus, relative to the swivel angle of the filler lid, a large operating path for the energy store results since it is attached to the other free end of the angle layer.

In addition to this feature it is essential that the switch is operated by displacement of the set of operating rods which is coupled between the energy store and the free end of the angle lever.

By the attachment of the filler lid to the angle lever and by the arrangement of the set of operating rods together with the energy store and the switch at the other end of the angle lever, a small swivel angle of the filler lid causes a large displacement of the operating rods. Thus a very finely differentiated switch point is obtained because for example, a swivel angle of 2° corresponds to a displacement of the operating rods by 10 cm.

Advantages are obtained by the combination of the two said features. The coupling of the filler lid via a set of operating rods to an energy store such that the energy store is tensioned upon closing of the filler lid and is relieved upon opening of the filler lid results in the advantage that the filler lid can be opened substantially without physical force because the necessary opening force is produced by the energy store. Furthermore the filler lid will no longer fall inadvertently under its own weight onto the press housing because the energy store in closing produces a counter force as it is tensioned by the closing movement.

According to the invention a sensitive, accurately differentiated switch is disposed in the path of the operating rod and the energy store so that switching off of power to the press platen is effected at a predetermined opening angular position of the filler lid, which angle is substantially independent of wear on the lid.

In a preferred embodiment of the present invention the energy store may be a coiled spring. It may be a traction spring or a compression spring.

In another embodiment the energy store may be a gas pressure spring. In addition to the energy store, further damping means may be used, for example, the connection in parallel of the energy store with a shock absorber. A particularly simple and reliable arrangement results if the switch has as an operating member, a sensing roller which engages a control rod of the operating rods, the said control rod having an angled portion which when the filler lid is closed, lies over the sensing roller.

The type and position of the angle determines the switch point of the switch. Of course, instead of this angle another type of control may be used, for example, a half-round shaped bend or the like.

Instead of a switch which is operated via a sensing roller it is also possible to use contactless switches.

It is proposed that the energy store and the switches are no longer disposed on the upper side of the press housing where they are substantially unprotected from dirt and other damage but instead that the energy store and the switch are disposed on the side wall of the press housing. It is proposed that the side wall of the press housing be covered by a covering wall so that a two-shell construction results between which are disposed the switch and the energy store. Thus the switch is protected from dirt and damage.

In order to obtain a margin of safety in the baling press against incorrect loading which could lead to the machine breaking down a further subject of the invention is a warning device for the filler opening of a baling press with a press piston movable to and fro in a press housing, the said press piston dividing the press housing into a pressing space for the compression of the bale and a movement space for the movement of the press piston.

The invention has as its object the provision of a warning device for the filler opening of a baling press which prevents material to be compressed from being loaded by mistake via the opened filler door into the movement space of the press piston.

With this object in view it is provided that in the vicinity of the filler door of the press housing there is attached to the press piston one or more movable safety bands which cover at least partially the movement space of the press piston in the press housing in the direction of the filler door.

An essential feature of the present invention is that whenever the press piston has traveled downwards and is located on the pressing face of the bale to be pressed in the vicinity of the filler door a warning device consisting of one or more movable safety bands is visible upon opening the filler door which makes it clear to the operator in a conspicuous manner that with the given position of the press piston no material can be introduced via the filler opening into the baling press.

One end of one or several of the safety bands is firmly attached to the front side of the press piston which is disposed next to the filler door.

The other free end of the one or more safety bands is arranged movably such that it is led around the upper side of the motion space over guide rollers and is weight loaded or spring loaded. During the compression stroke of the press piston the safety bands are at the same time drawn down from the upper side of the motion space like a roller blind so that these cover at least partially the filler opening when the press piston is located on the press face of the bale being pressed.

If the safety band is provided with a warning message (for example, "Throw no material in now") the warning function is particularly clear. As soon as the press piston is again driven into its end position and rises from the press face of the bale to be pressed, the safety bands are again rolled in or taken up such that in the end resting position of the press piston when it contacts the upper limit of the movement space they are not visible from the filler opening when the filler door is opened.

The use of safety bands made of plastics material is simple and inexpensive. Movable shutters or foldable safety bands could be used so that the idea of the invention is not limited to safety bands, weight loaded or spring loaded or capable of being rolled up. It is only essential that in the vicinity of the filler door of the press housing one or more safety bands are disposed in the motion space, the said safety bands covering at least partially the filler opening of the press housing positioned too low in the housing for loading to be carried out.

A particularly effective arrangement occurs when the plane of the safety bands is approximately parallel to the plane of the filler door so that when the filler door is opened and the press piston is located on the pressing face of the bale the warning inscription on the safety bands is evident to the user.

In a further embodiment of the present invention, it is arranged that the safety bands are disposed movably such that one end is attached to the press piston and their other free end is attached to a spring loaded or weight loaded winding apparatus. Such a winding apparatus would, for example, be a roller blind known in window coverings.

The only object of these different spring and weight loads on the free ends of the safety bands is the the holding of the safety bands taut and also their shortening and moving along with the press piston as it is driven into its end resting position and the movement space becomes negligible in size. Therefore, instead of the spring or weight loading of the safety bands a folding device or other device may be used as long as it conforms to these requirements.

This invention is explained in more detail in the following with reference to the drawings.

FIG. 2 shows in perspective an arrangement of safety bands according to the invention in a second embodiment baling press, with the press door opened;

FIG. 3 shows diagrammatically a side view of the safety bands according to FIG. 2 and their movable mounting; and FIG. 4 shows an alternative construction of the safety bands.

Figures 1, 1A:
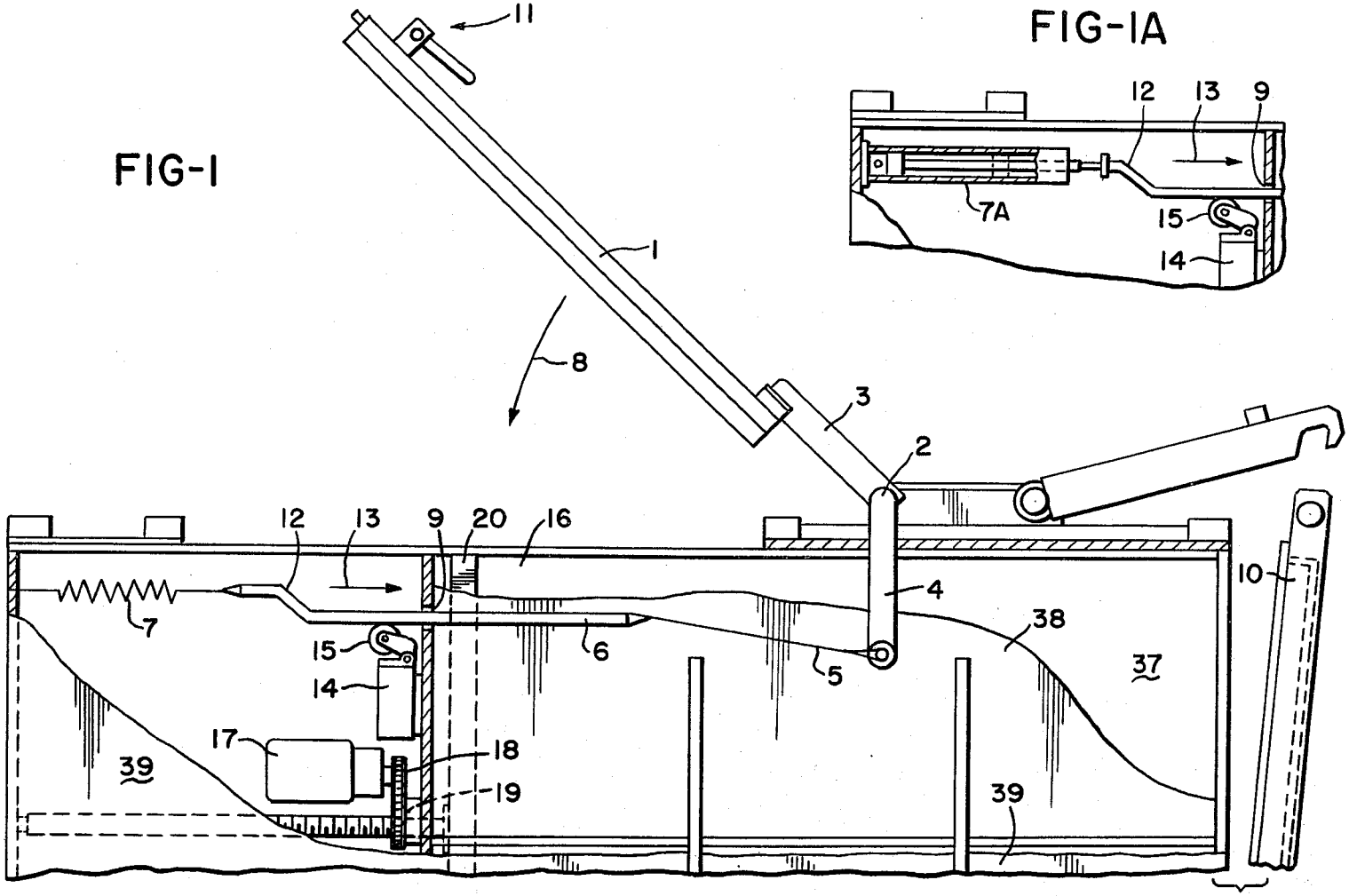
FIG. 1 shows diagrammatically in part representation the side view of a baling press with the parts essential to the invention.
FIG. 1A is an enlarged partial view showing a pneumatic cylinder or gas compression spring utilized in one form of the invention.

Referring to FIG. 1, a pressing plate 20 disposed in press housing 16 is movable in the direction of arrow 13 by a drive system, including motor 17, sprocket and drive chain 18, a rotatable nut 19 and the lead screw or spindle shown, to compress the material to be baled against a press door 10 while the door is secured closed, this door being shown in FIG. 1 in a partially open position.

On the upper side of the press housing 16 is disposed a pivot 2 in which on both sides of the side walls of the press housing is hinged respectively an angle lever 3, 4 consisting of the upper lever part 3 and the lower lever part 4. The pivot 2 is therefore continuous over the whole width of the press housing 16 whereby on both sides respectively an angle lever 3, 4 may be hinged.

In another embodiment it is possible to provide the angle lever 3, 4 only on one side wall of the press housing.

On the upper end of the lever part 3 is hinged the filler lid 1. It is pivoted in the direction of the arrow 8 into its closed position wherein a locking device 11 engages with the press housing so that the filler lid 1 covers the filling opening (not shown) of the baling press.

On the other end of the lever part 4 is located a set of operating rods consisting of the rods 5 and a control bar 6. The rods 5 may be formed as a wire cable. The control bar 6 is mounted in a recess 9 in the side wall of the press housing 16 and has at its far end an angled portion 12 which defines the switch point for the switch 14. The extreme end of the control bar 6 is connected to a coiled spring 7 which in the embodiment serves as an energy store.

Upon pivoting of filler lid 1 in the direction of arrow 8 into its closed position, the control rod 6 is moved in the direction of arrow 13 to position angled portion 12 of the control rod above switch roller 15, whereupon the upwardly spring-urged sensing member or roller 15 pivots clockwise to operate electrical control switch 14 to turn on and energize and actuate the press drive. Upon the pivoting of the filler lid 1 in the direction opposite from the direction of arrow 8, clockwise as viewed, toward its open position, the control rod is moved leftward, as viewed, to depress switch roller 15 to turn off the switch and deenergize the press drive.

It can be seen that due to the length of the lever part 4 a long operating path in the direction of the arrow 13 results so that the small pivot angles of the filler lid 1 lead to a large displacement of the control rod 6. In this way the energy store 7 is pretensioned during the closing movement and can then give up its energy during the opening movement so that the filler lid opens substantially automatically by pivoting upwards in the opposite direction to the arrow 8.

The operating mechanism is preferably mounted on a wall of the press housing 16, as shown. The press housing comprises side walls 37, 38, the end walls shown and the upper and lower walls shown. It protects the switch 14 and other components from manipulation and contamination. A covering wall 39 extends across the entire side of the baling press.

It is of course possible to provide other energy stores corresponding to the coiled spring 7 on both side walls of the press housing. Instead of the traction spring used a compression spring may be used. FIG. 1A illustrates an energy store in the form of a pneumatic cylinder and piston arrangement or gas compression spring 7A.

In FIG. 2 there is shown an example of a press housing 21 in which a press piston 22 is movable vertically.

The press piston 22 in the position shown divides off a press space 33 in which the bale is compressed against the bottom face of the press housing 21 from the movement space 34 above the press piston 22.

The front of the press housing 21 is covered by a press door 23 in which is disposed a filler door 24 capable of being opened separately to reveal a corresponding filler opening in the press housing.

In making a bale the press piston 22 is first driven upwards in the direction of the arrow 31, then with closed press door 23 the filler door 24 is opened so that material to be compressed can be loaded into the press housing 21. The material falls downwards in the direction of the arrow 32 onto the bottom of the press housing 21. The filler door 24 is then closed and the press piston 22 is driven downwards in the direction of the arrow 32 from its upper resting position 35. The material is thus compressed by the press piston 22 into the form of a bale. The press piston 22 is again driven upwards in the direction of the arrow 31 into the position 35 and the filler door 24 is again opened and again material to be compressed is loaded into the filler opening. The filler door 24 is then closed again and the press piston 22 is started from its position 35 and again runs downwards in the direction of the arrow 32 so that the newly filled material is compressed on the already part formed bale.

A situation as in FIG. 2 may now result. Here the press piston 22 is still driven downwards and separates the press housing into a press space 33 and a movement space 34 disposed thereover.

If in this position with closed press door 23 the filler door 24 is opened the operator cannot always see that the press piston 22 is in the position shown in FIG. 2. The operator may be misled into loading material through the filler opening of the press door 24 into the movement space 34 where the material is detrimentally compressed against the cover face of the press housing 21 when the press piston 22 is started upwards in the direction of the arrow 31.

In order to avoid this undesired operation of the baling press the invention provides that safety bands 26 be provided in the movement space 34 of the press housing 21.

One or more safety bands 26 may be provided, but in the embodiment described there are two safety bands spaced apart and parallel to one another. One end of each safety band 26 is connected to the front side of the press piston 22. The other end is as shown in FIG. 3 led over guide rollers 27, 28 on the upper side of the movement space 34 inside the press housing 21, and may be loaded, for example with a weight 30.

As shown in FIGS. 2 and 3, the press piston 22 is driven by a spindle 29. The spindle 29 has an outer screw thread which engages by means of a corresponding inner screw thread on the press piston 22. With the drive of the spindle 29 the press piston 22 may be moved upwards in the direction of the arrow 31, thereby enlarging the press space 33 and reducing the movement space 34.

Since one end of each safety band 26 is loaded with a weight, when the press piston 22 travels upwards in the direction of the arrow 31 each safety band 26 is shortened because the end loaded with the weight 30 is also drawn downwards in the direction of the arrow 31.

Instead of the arrangement of a weight 30 the end against the press housing 31. Instead of a weight 30 or a spring, a spring loaded winding apparatus, as in a spring blind roller, may be used.

It is also possible to fold or otherwise shorten the safety band when the press piston 22 is driven upwards in the direction of the arrow 31. Conversely when the press piston 22 is moved downwards in the direction of the arrow 32 the safety bands 26 are drawn over the movement space 34 or its front side in the vicinity of the filler opening of the filler door 24. The course of movement of FIG. 3 is then reversed.

FIG. 4 shows that crossed safety bands 36 may be used. They may lie arranged as a lattice and may be provided with stamps or characterizing colors of the manufacturers.

I claim:

1. A safety device for inactivating a pressing plate drive of a baling press when a filler lid pivotally mounted on a press housing is opened, said safety device comprising:

switch means disposed on the housing in a position remote from the path of movement of the filler lid, said switch means being operative to energize the pressing plate drive and including a sensing member, lever means rigidly connected to the filler lid and extending from the pivotal mounting of the lid in a direction opposite from the lid, operating rod means connected to the lever means and configurated and arranged to move in a displacement path to engage the switch sensing member upon opening movement of the lid to operate the switch means to inactivate the pressing plate drive, and energy store means connected to the operating rod means to store energy during closing movement of the filler lid and to release stored energy during opening movement of the lid.

2. A safety device according to claim 1, wherein:

said lever means comprises a first arm pivotally connecting the filler lid with the press housing, and a second arm extending from the pivotal connection oppositely from the first arm and being connected with the operating rod means and energy store means.

3. A safety device according to claim 2, wherein:

said energy store means comprises a helical spring.

4. A safety device according to claim 3, wherein:

said operating rod means has an inclined portion to depress the sensing member to operate the switch means disposed in the displacement path of the operating rod means.

5. A safety device according to claim 2, wherein:

said energy store means comprises a gas compression spring.

6. A safety device according to claim 2, wherein:

said operating rod means has an inclined portion to depress the sensing member to operate the switch means disposed in the displacement path of the operating rod means.

7. A safety device according to claim 2, wherein:

the switch means and the energy store means are mounted on walls of the press housing.

8. A safety device according to claim 1, wherein:

said energy store means comprises a helical spring.

9. A safety device according to claim 8, wherein:

said operating rod means has an inclined portion to depress the sensing means to operate the switch means disposed in the displacement path of the operating rod means.

10. A safety device according to claim 1, wherein:

said energy store means comprises a gas compression spring.

11. A safety device according to claim 1, wherein:

said operating rod means has an inclined portion to depress the sensing member to operate the switch disposed in the displacement path of the operating rod means.

12. A safety device according to claim 11, wherein:

the switch means and the energy store means are mounted on walls of the press housing.

13. A safety device according to claim 1, wherein:

the switch means and the energy store means are mounted on walls of the press housing.

14. A safety device according to claim 13, and further including:

wall means cooperating with said walls to enclose and shield the switch means and energy store means against manipulation and contamination.

* * * * *